US008572766B2

(12) United States Patent
Shull et al.

(10) Patent No.: US 8,572,766 B2
(45) Date of Patent: Nov. 5, 2013

(54) SOCKS HAVING AREAS OF VARYING STRETCHABILITY AND METHODS OF MANUFACTURING SAME

(75) Inventors: James Troy Shull, Plano, TX (US); Matthew Curry Shull, Naperville, IL (US)

(73) Assignee: Bear In Mind Company, Plano, TX (US)

( * ) Notice: Subject to any disclaimer, the term of this patent is extended or adjusted under 35 U.S.C. 154(b) by 196 days.

(21) Appl. No.: 12/930,707

(22) Filed: Jan. 14, 2011

(65) Prior Publication Data

US 2012/0180195 A1 Jul. 19, 2012

(51) Int. Cl.
*A41B 11/00* (2006.01)

(52) U.S. Cl.
USPC ..... 2/239

(58) Field of Classification Search
USPC ..... 2/239, 240, 241, 242, 409; 66/185, 186, 66/170 R, 182, 183
See application file for complete search history.

(56) References Cited

U.S. PATENT DOCUMENTS

| | | | | | |
|---|---|---|---|---|---|
| 788,996 | A * | 5/1905 | Böttger, Jr. | 66/202 |
| 858,006 | A * | 6/1907 | Lum | 2/239 |
| 967,585 | A * | 8/1910 | Teufel | 602/60 |
| 1,216,374 | A * | 2/1917 | Smith | 66/187 |
| 1,936,038 | A * | 11/1933 | Schindler | 66/185 |
| 2,050,535 | A * | 8/1936 | Martel | 66/178 R |
| 2,102,368 | A * | 12/1937 | Martel | 66/182 |
| 2,219,235 | A * | 10/1940 | Morton | 2/239 |
| 3,386,270 | A * | 6/1968 | Simmons | 66/178 A |
| 4,253,317 | A * | 3/1981 | Howard et al. | 66/186 |
| 4,341,097 | A * | 7/1982 | Cassidy et al. | 66/187 |
| 5,103,656 | A * | 4/1992 | Hanson, II | 66/185 |
| 5,473,781 | A * | 12/1995 | Greenberg | 2/239 |
| 5,617,745 | A * | 4/1997 | Della Corte et al. | 66/178 A |
| 6,012,177 | A * | 1/2000 | Cortinovis | 2/239 |
| 6,139,929 | A * | 10/2000 | Hayton et al. | 428/35.2 |
| 6,286,151 | B1 * | 9/2001 | Lambertz | 2/239 |
| 6,336,227 | B1 * | 1/2002 | Liput et al. | 2/239 |
| 6,536,051 | B1 * | 3/2003 | Oh | 2/239 |
| 6,708,348 | B1 * | 3/2004 | Romay | 2/239 |
| 6,805,681 | B2 * | 10/2004 | Yokoyama | 602/65 |
| 7,007,517 | B2 * | 3/2006 | Menzies | 66/185 |
| 7,069,600 | B1 * | 7/2006 | Romay | 2/239 |
| 7,192,411 | B2 * | 3/2007 | Gobet et al. | 602/63 |
| 7,434,423 | B1 * | 10/2008 | Reid et al. | 66/178 A |
| 7,441,419 | B1 * | 10/2008 | Dollyhite et al. | 66/178 A |
| 7,552,603 | B2 * | 6/2009 | Dahlgren | 66/185 |
| 7,677,061 | B2 * | 3/2010 | Mori et al. | 66/185 |
| 7,681,254 | B2 * | 3/2010 | Lambertz | 2/239 |

(Continued)

*Primary Examiner* — Richale Quinn
(74) *Attorney, Agent, or Firm* — Carstens & Cahoon, LLP; James H. Ortega

(57) ABSTRACT

Disclosed herein are wearable socks, and related methods of manufacturing such socks, having selected areas of substantially greater stretchability as compared to the remaining portions of the sock that that resists removal by the wearer. In one exemplary embodiment, a sock constructed according to the disclosed principles may comprise first portions of the sock comprising a material having a first overall stretchability, and second portions of the sock comprising a material having a second overall stretchability. Additionally, in such exemplary embodiments, the second stretchability is substantially greater than the first stretchability such that one or more of the second portions are configured to continue to stretch in response to a removal force applied to the sock while adjacent one or more first portions reach their maximum stretchable length which thereby allows the removal force to overcome a compressive force of the one or more first portions.

18 Claims, 21 Drawing Sheets

(56) References Cited

U.S. PATENT DOCUMENTS

| | | | | |
|---|---|---|---|---|
| 7,721,575 | B2 * | 5/2010 | Yokoyama | 66/185 |
| 7,757,518 | B2 * | 7/2010 | Sho et al. | 66/185 |
| D624,300 | S * | 9/2010 | Hollingsworth et al. | D2/980 |
| 7,950,071 | B2 * | 5/2011 | Jeong | 2/239 |
| 7,971,280 | B2 * | 7/2011 | Kaneda | 2/239 |
| D643,207 | S * | 8/2011 | Hollingsworth et al. | D2/980 |
| 7,996,924 | B2 * | 8/2011 | Wright et al. | 2/239 |
| D650,969 | S * | 12/2011 | Wong | D2/624 |
| 2003/0230121 | A1 * | 12/2003 | Yokoyama | 66/178 A |
| 2007/0033711 | A1 * | 2/2007 | Achtelstetter | 2/239 |
| 2009/0018482 | A1 * | 1/2009 | Lambertz | 602/65 |
| 2009/0126081 | A1 * | 5/2009 | Lambertz | 2/239 |
| 2009/0165190 | A1 * | 7/2009 | Araki et al. | 2/240 |
| 2009/0276939 | A1 * | 11/2009 | Sho et al. | 2/239 |
| 2011/0107501 | A1 * | 5/2011 | Kawahara | 2/239 |
| 2012/0102625 | A1 * | 5/2012 | Klein | 2/239 |

* cited by examiner 100c
9a 100d
9b

SOCKS HAVING AREAS OF VARYING STRETCHABILITY AND METHODS OF MANUFACTURING SAME

TECHNICAL FIELD

The present disclosure is related in general to wearable socks, and more particularly to socks, wearable for example by infants, having selected areas of substantially greater stretchability as compared to the remaining portions of the sock that resist removal by the wearer.

BACKGROUND

Sock are manufactured by the millions each year, typically using automated circular knitting machines. During such a manufacturing process, the operator sets up the machines with various spools of yarn and programs it to create a particular design or pattern. Once the knitting process is completed, the sock may go through various sewing, dyeing, and finishing steps as well, before it is packaged and shipped to a retail store for sale to consumers.

Socks are just one of the essential articles of clothing required for an infant. The primary function of socks for infants is to keep the infants warm since they are unable to regulate their body temperatures, and since significant heat is lost at the infants' extremities. Like socks for adults, infant socks in the market today are available in a variety of patterns, themes and composition. They are typically comprised of various knit materials, such as cotton, bamboo, polyester, nylon, Spandex, and other synthetics or natural fibers. A typical infant sock could be 80% cotton, 17% nylon, and 3% Spandex. These percentages are relative to the weight of the sock, not the area of the sock. In other words, the sock may be 80% cotton by weight.

When the infant sock is knitted on a circular knitting machine, some type of knit material, or even elastic knit material, is usually used in the cuff to secure the sock to the foot. In the other areas of the sock (e.g., sock body, toe, and/or heel), the same or similar knit materials, such as cotton, nylon, and Spandex, are typically uniformly knitted throughout these areas. The inclusion of such materials is used to add more compressive capability to the sock. In this conventional approach, a more elastic cuff is used to impart greater compression on the corresponding part of the leg, as compared to the remainder of the sock on the foot, thereby attempting to keep the sock on the wearer.

However, even though compressive properties via select materials and construction techniques have been added to socks, keeping socks on an infant remains a challenge to all parents and caretakers. Simply put, babies like to take off their socks and discover their toes. When in a stroller, crib, or car seat, infants tend to pull on the toes of their socks until they remove them, whether intentionally or not. Moreover, infants also tend to shuffle their feet in a car seat or stroller, where the friction of the heel of the sock against the car seat or other structure often results in removal of the socks. Often, these socks are lost, and not only are missing socks expensive to replace but this also presents an inconvenience when extra socks are not readily available. Additionally, even if extra socks are available or cost is not a concern, sock removal may go unnoticed for a period of time sufficient for foot exposure to cause discomfort to the infant.

With the above problems and concerns in mind, several conventional attempts to address undesirable sock removal have been explored. For example, in U.S. Pat. No. 4,976,050, Houghteling proposed an elastic strap with a snap which wrapped around the infant's ankle. This approach attempts to prevent the loss of socks by a constrictive force applied to the ankle or calf by the strap. However, if the elastic strap does not fit properly around the ankle or calf, then the socks could still be removed from the foot. Also, if an elastic strap of hook-and-loop type is employed, it could possibly cause scratches or irritations to the skin of the infant if he or she rubbed his or her foot or leg against the other foot or leg. Alternatively, if the elastic is too tight around the infant's ankle or calf, this could disrupt the circulation to the foot in addition to causing discomfort to the child. Furthermore, Houghteling's proposal requires more materials and additional manufacturing steps, not to mention additional steps needed simply to place socks on the infant's feet.

In a separate conventional approach, in U.S. Pat. No. 6,247,183, Haas-Laursen proposed a strap which is connected to the infant's sock and clothing. Although this approach attempts to prevent the loss of socks, it requires more materials such as a strap, as well as requiring additional finishing steps in the manufacturing process. Furthermore, the infant must be wearing another piece of clothing in addition to the sock in order to implement the Haas-Laursen system.

SUMMARY

In order to overcome the deficiencies of the above-discussed, as well as other, conventional approaches, socks constructed according to the disclosed principles require no additional mechanical components added to the socks. The socks can be manufactured using standard circular knitting machines found at any typical knitting mill. Rather than having a uniform, balanced knit of cotton and nylon/Spandex, for example, the structural design of the sock is varied in the amount and type of yarn used in particularly selected areas of the sock. These variations in yarn in select areas modify the structural design such that the sock is prevented from being pulled off the infant's foot or otherwise undesirably removed by the infant. More specifically, the disclosed variations change the elasticity, and thus the stretchability, of the sock in the specially selected areas, which helps prevent an infant from easily removing his/her sock from the foot. This is accomplished because some areas of the sock are more elastic and therefore more stretchable than other areas. This results in the substantially more stretchable areas of the sock absorbing removal forces by continuing to stretch, when the same removal force as applied to the remaining areas of the sock has caused those other areas to reach their maximum stretchable length which thereby allows the removal force to overcome the compressive force of those areas and thus slide along the foot towards removal.

In exemplary embodiments, the various portions of the sock could be comprised of a cotton yarn and a nylon/Spandex yarn. It is an industry known fact that Spandex is an elastic, flexible material that stretches more than cotton. Spandex fiber in particular can stretch up to six times its relaxed length. In hosiery, Spandex is used to impart compression to the garment. In a baby sock, nylon/Spandex can improve the grip (i.e., compressive force) of the sock on the baby's foot. However, in some embodiments, the disclosed principles instead capitalize on the elasticity, and thus the stretchability, of a nylon/Spandex yarn by increasing the area percentage of nylon/Spandex in particularly selected areas of the sock. For example, area may be increased by increasing the nylon/Spandex yarns in select areas, or by having nylon/Spandex yarn with a denier that is different than the denier in the other areas of the sock. In other embodiments, the disclosed principles employ a different kitting or other manufacturing pattern for the select areas of increased stretchability, as compared to the remaining portions of the sock, to provide the stretchability in the select regions. What matters is the substantial increase in stretchability provided in the select areas as compared to the remaining areas of the sock. For example, a conventional baby sock may have a uniform knit of cotton and nylon/Spandex, or even other materials, in all areas of the sock with the possible exception of the cuff. But this uniform material, no matter the percentages of each, distributed on the sock provides the same resistance to removal on any corresponding portion of the foot. However with a sock constructed according to the disclosed principles, when a baby pulls on the toe of the sock or rubs the heel of the sock against another object, the specifically selected areas of the sock stretch substantially more than the remaining areas. Therefore, the differences in stretchability between the specifically selected areas and the remaining areas help keep the sock on the foot.

In one exemplary embodiment, a sock constructed according to the disclosed principles may comprise first portions of the sock comprising a material having a first overall stretchability, and second portions of the sock comprising a material having a second overall stretchability. Additionally, in such exemplary embodiments, the second stretchability is substantially greater than the first stretchability such that one or more of the second portions are configured to continue to stretch in response to a removal force applied to the sock while adjacent one or more first portions reach their maximum stretchable length which thereby allows the removal force to overcome a compressive force of the one or more first portions. Moreover, in some embodiments, yarns comprising the second material differ from yarns comprising the first material, where the yarns of the second material have a substantially greater elasticity than the yarns of the first material to provide the substantially greater stretchability of the second portions. Alternatively, yarns comprising the first material are the same as yarns comprising the second material, wherein a knitting pattern of the second material differs from a knitting pattern of the first material to provide the substantially greater stretchability of the second portions. These and other exemplary embodiments are discussed in further detail below.

DETAILED DESCRIPTION

Figure 1:
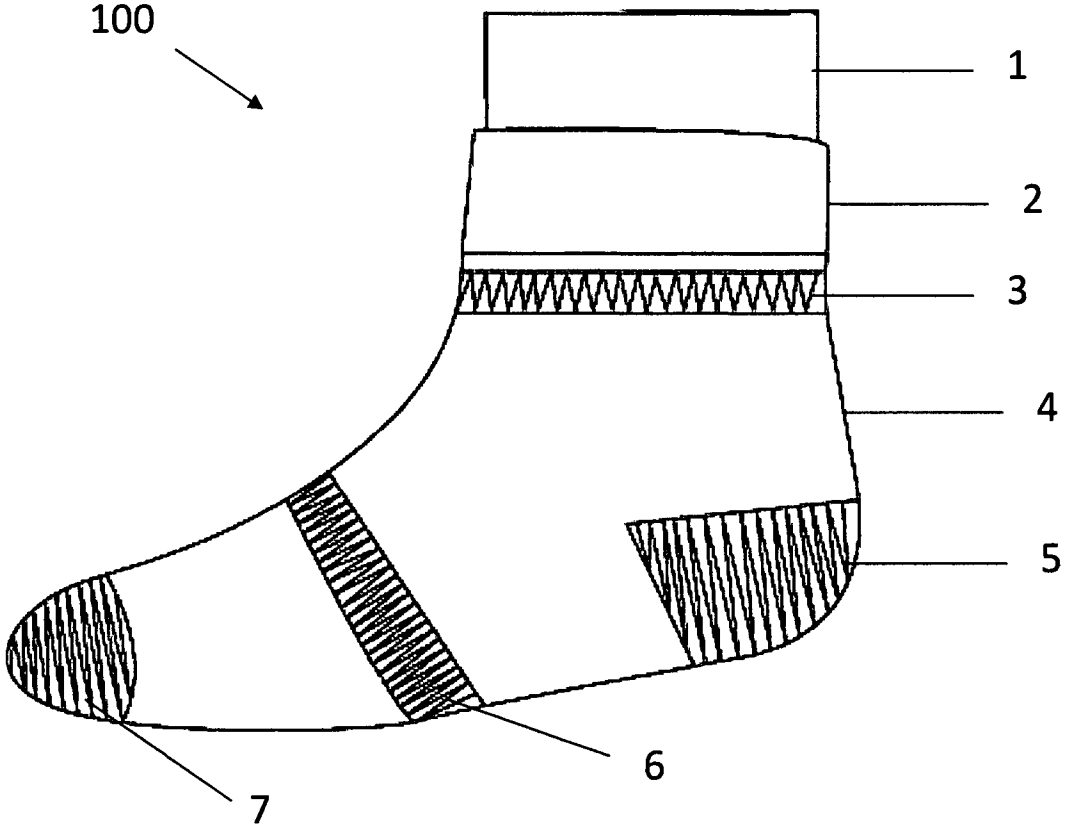
FIG. 1 illustrates a side view of a first embodiment of a sock constructed according to the disclosed principles.

Looking first and FIGS. 1-4, illustrated are various view of a first exemplary embodiment of a sock 100 constructed according to the disclosed principles. Below is a list of the items illustrated in FIGS. 1-4, however, it should be noted that this list may not necessarily be exhaustive. Thus, related embodiments may have varying items, yet such embodiments may still fall within the disclosed principles.

Illustrated Items:

1. Leg
2. Cuff of the sock
3. Ankle band
4. Sock body
5. Heel
6. Foot cross band
7. Toe
8. Foot top strap
9. Foot bottom strap
10. Achilles strap In this exemplary embodiment, items 2 through 10 of the sock 100 may be comprised of a knit material. This material could be, but is not limited to, cotton, wool, bamboo, polyester, nylon, Spandex, or a blend of any one of these materials. As shown in FIGS. 1-4, items 3, 5, 6, 7, 8, 9 and 10 are selected areas that that are more elastic and stretchable (as specifically shown by the zig-zags in material) than the material used to form the cuff and sock body, items 2, 4. The differences in stretchability and elasticity of the materials between items 3, 5, 6, 7, 8, 9 and 10 as compared to the cuff/sock body areas help prevent the child from removing the sock by either pulling on it or shuffling his/her feet against another object. When a baby pulls on the toe 7 of the sock, items 3, 5, 6, 7, 8, 9 and 10 can stretch, which helps keep the sock on the foot. Likewise, when the baby rubs its heel 5 against another object, such as a crib or car seat, items 3, 5, 6, 7, 8, 9 and 10 can stretch and thereby help keep the sock on the foot. Specifically, the selected areas for the more elastic materials, in this embodiment items 3, 5, 6, 7, 8, 9 and 10, can each (or a combination or two more items) provide greater stretchability as compared to remaining areas of the sock when the sock is pulled by the toe area 7, or rubbed on the heel 5 or side area. Thus, these selected areas allow sections of the sock to stretch and thereby recover from the stress of being pulled on or rubbed, rather than reaching a maximum elasticity that allows the sock to be more easily removed.

Stretchable materials have a given stretchability that is provided by that material's elasticity. So when that material is used to make a sock, and the sock is designed to stay on the foot of the wearer, the elasticity of the material at certain areas of the sock provides a compressive force on the corresponding portion of the foot, ankle or leg. When a pulling force is applied to the toe of the sock, or the heel of the sock is rubbed against an object, the material of the sock does somewhat stretch in certain areas. However, the limited elasticity of conventionally used materials, such as knitted cotton, only provides limited stretching in response to the removal force. Since the maximum elasticity of the materials is therefore prematurely reached, the removal force is directly applied to the compression force keeping the sock on the foot. When the removal force is thus directly applied at the maximum stretchability of the sock material, that removal force can then overcome the compression of the sock and the sock is removed from the foot. Thus, the disclosed principles provide for select areas of a sock to be constructed such that the select areas are substantially more stretchable than the remaining portions of the sock, when all portions of the sock area constructed to have substantially the same compressive force on the foot/ankle/leg. As used herein, substantially greater stretchability means the select areas have at least 1.5 to 2 times the stretchability of the remaining portions of the sock. Therefore, while the portions of the sock constructed from the conventional knitted material may reach its maximum stretchability prematurely, thus allowing the removal force to be directly applied to the compressive force on those areas of the sock, the selected areas added as disclosed herein continue to stretch in response to the removal force(s). Thus, these select portions of the sock counteract the removal force by continuing to stretch in response to the removal force, thereby preventing the removal force from overcoming the compressive forces that continue to hold the sock on the foot. Accordingly, the portions of the sock selected to provide the additional elasticity should have an elasticity sufficient to allow the selected portions of the sock to stretch in response to the pulling or rubbing force applied by the wearer, rather than reaching a maximum stretched length and allowing the pulling or rubbing force to overcome the compression of the sock against the skin and thereby be removed.

Any materials in items 3, 5, 6, 7, 8, 9 and 10 which exhibit more elasticity and stretchability than the material in items 2, 4 may be used. For example, the yarns may be cotton in items 2, 4 and nylon/Spandex in items 3, 5, 6, 7, 8, 9 and 10. Although the nylon/Spandex yarn can help the grip of the sock on the baby's foot, more importantly the nylon/Spandex areas will stretch when the baby pulls on the toe or rubs its heel against another object thereby helping to keep the sock on the foot. Thus, even if the amount of nylon/Spandex used in the designated areas is selected to have the same compressive force as the other (e.g., cotton) areas of the sock, the substantially greater elasticity (and thus stretchability) of the nylon/Spandex areas allows these areas of the sock to "give" when pulled on or otherwise stretched, rather than reaching their maximum elasticity (i.e., maximum outstretched length) and allowing the removal force to overcome the compression of the sock on the foot.

What matters is that the material in the selected areas of the sock has greater elasticity as compared to the material forming the remaining portions of the sock, when all areas of the sock are constructed to have substantially the same compressive force on its corresponding part of the foot, ankle or leg. The greater the elasticity in the selected areas when compared to the remainder of the sock, the more resistance to removal is provided by the select areas continuing to stretch in response to removal forces, when conventional areas of the sock have already reached their maximum stretchability. Thus, while the selected areas may be constructed to have 1.5 to 2 times the stretchability of the remainder of the sock, a sock constructed where the selected areas are 4 to 5 times, or even more, elastic than the remainder of the sock will provide even more resistance to removal when other manufacturing factors are kept the same.

Moreover, the percentage of nylon/Spandex (or other material having substantially more elasticity than the remaining areas of the sock) per area in items 3, 5, 6, 7, 8, 9 and 10 is preferably greater than the percentage of Spandex in the given area of the cuff and sock body. Although nylon/Spandex is mentioned in this example, any knit materials in items 3, 5, 6, 7, 8, 9 and 10 that have substantially more elasticity (and thus stretchability) than the materials used in items 2, 4 may be employed with the disclosed principles.

Furthermore, although different materials for the selected areas of the sock have been discussed above, it is also possible to construct the entire sock from the same type of material (e.g., all cotton, etc). In such embodiments, however, the select areas would then be constructed in such a way as to provide the substantially greater elasticity when compared to the remainder of the sock. For example, this could be done by using a knit pattern in the select areas that allows greater stretchability across a given area of material than the knit pattern used in the material comprising the remainder of the sock. Put succinctly, it is the selected areas of the sock that have substantially greater elasticity and stretchability than the remaining portions of the sock, whether that greater elasticity and stretchability is provided by the type of yarn/material employed or by the type of material construction is employed. Accordingly, by selecting specific areas of the sock to have substantially more stretchability than the remaining areas of the sock, a sock constructed as disclosed herein is less likely to be pulled from the infant's foot, whether by pulling from the toe of the sock or by rubbing the sock against an object. Thus, a sock constructed as disclosed herein may be constructed with no cotton at all, so long as the specifically selected areas of the sock discussed herein are constructed with materials having substantially greater elasticity and stretchability than the remaining portions of the socks. The selected areas of the sock may, but are not required to, have the same elasticity and stretchability as other selected areas. The remaining portions may, but are not required to, have the same elasticity and stretchability as other remaining portions. The elasticity and stretchability within a selected area may, but is not required to, be the same. The elasticity and stretchability within a remaining portion may, but is not required to, be the same. Additionally, the locations of the items and the physical dimensions in the figures disclosed and discussed herein are for reference only and may vary depending on the structural design determined by the person or persons designing and/or manufacturing the sock.

Figure 2:
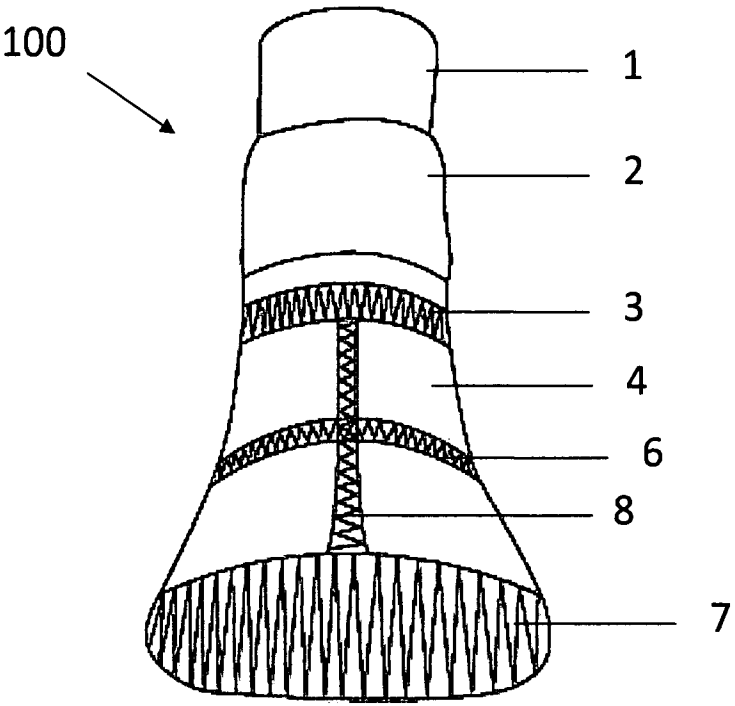
FIG. 2 illustrates a front view of the embodiment of a sock illustrated in FIG. 1.
Figure 2B:
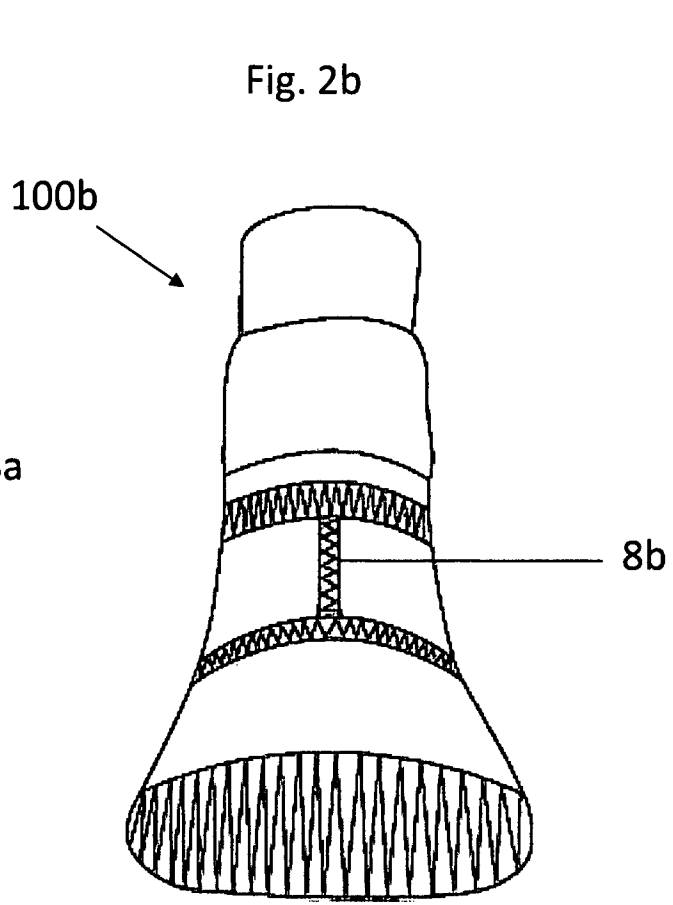
FIG. 2*b* illustrates a front view of an alternative embodiment of the sock illustrated in FIG. 1.
Figure 2A:
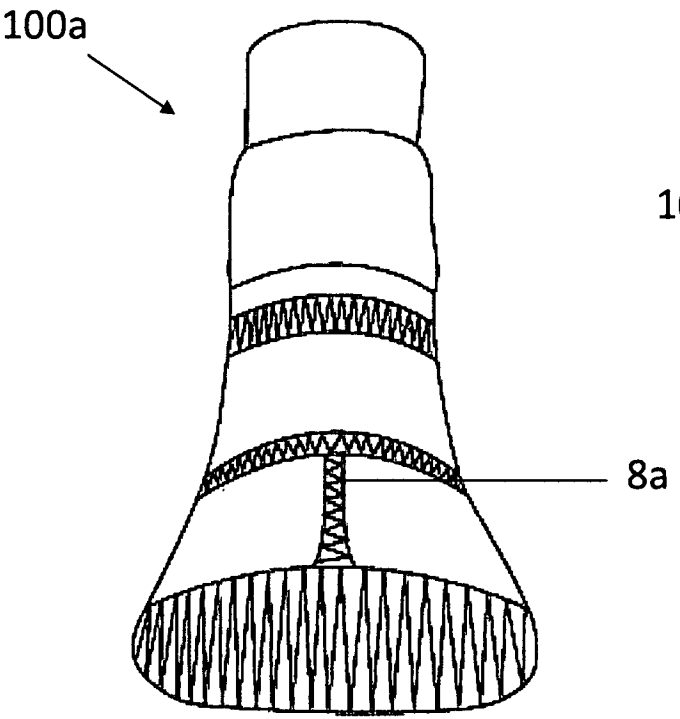
FIG. 2*a* illustrates a front view of an alternative embodiment of the sock illustrated in FIG. 1.

Referring again to FIGS. 1-4, when using the foot top strap 8 in this first illustrated embodiment, the foot top strap is preferably connected from the toe portion 7 to the ankle band 3, as illustrated in FIG. 2. However, in alternative embodiments, the top strap 8 could also be connected from the toe portion 7 to the foot cross band 6 as illustrated in FIG. 2*a*. Alternatively, the foot top band 8 could be connected from cross band 6 to the ankle band 3, as illustrated in FIG. 2*b*. The embodiments in FIGS. 2, 2*a*, and 2*b*, may stretch differently when the baby pulls on the toe or rubs its heels on an object, yet can still help keep the sock on the foot.

Figure 3:
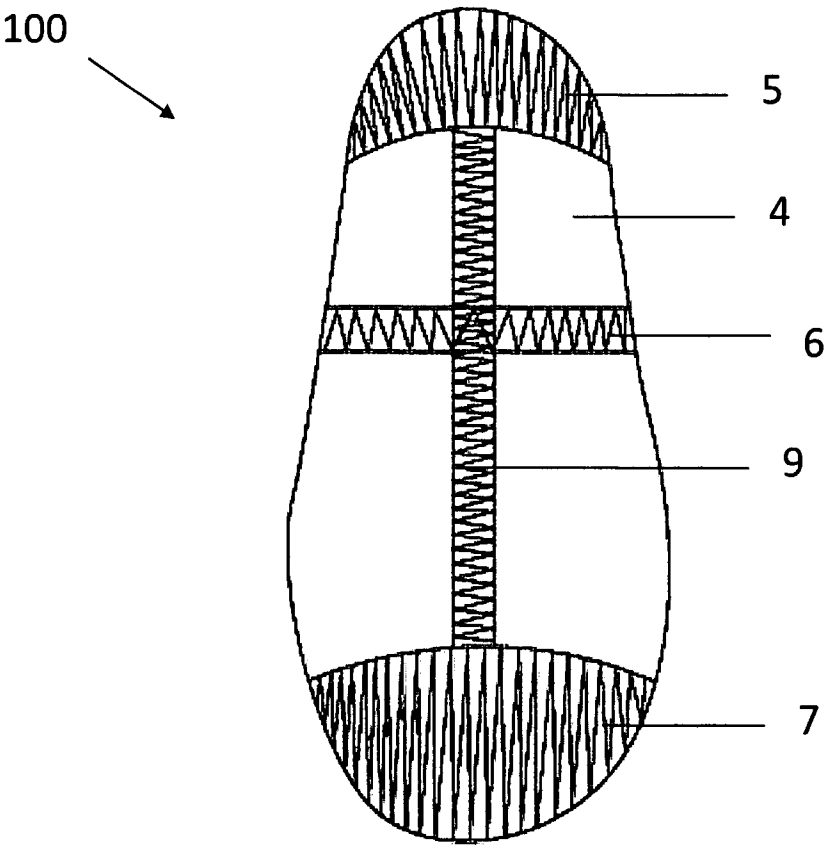
FIG. 3 illustrates a bottom view of the embodiment of a sock illustrated in FIG. 1.
Figures 3A, 3B:
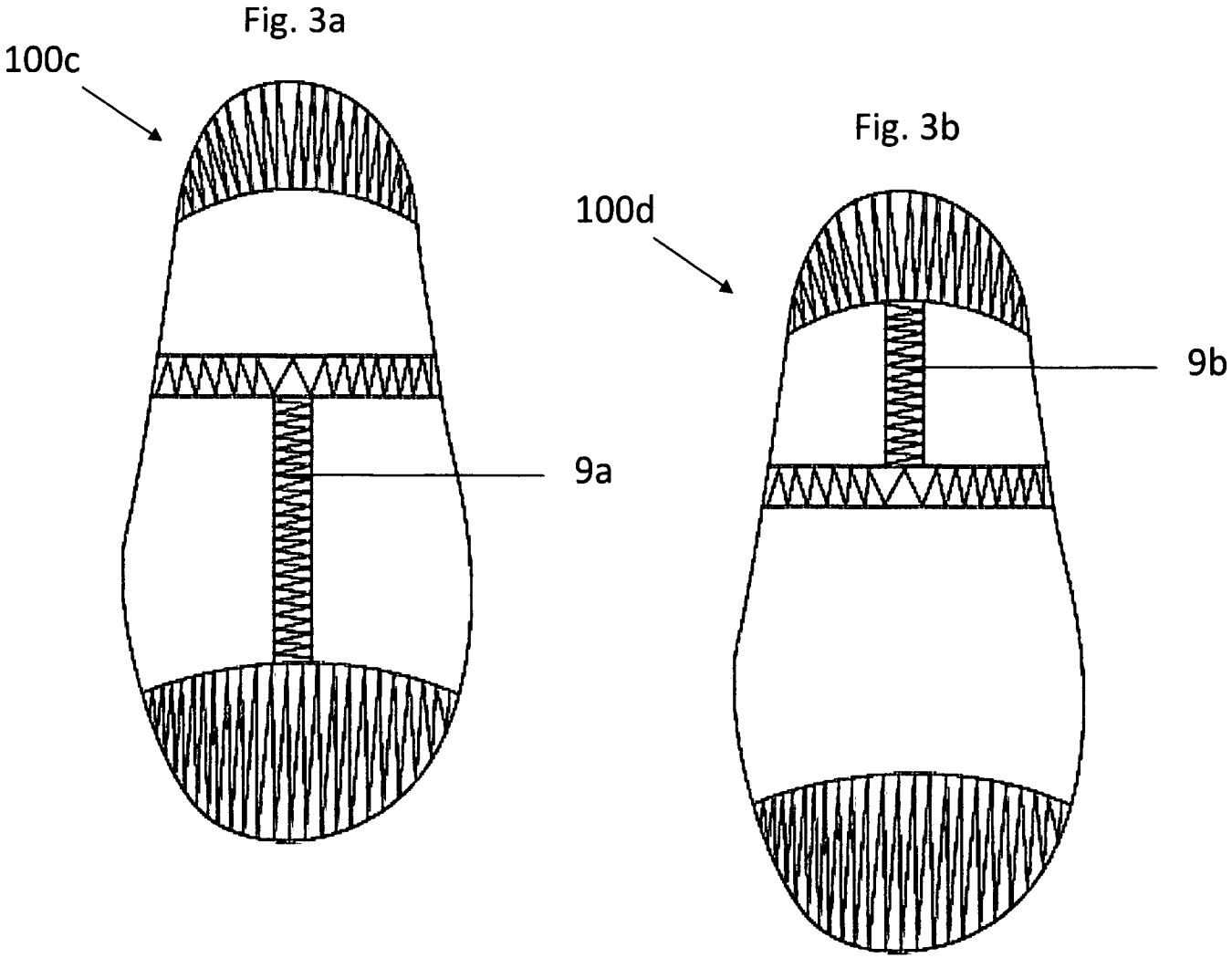
FIG. 3*a* illustrates a bottom view of an alternative embodiment of the sock illustrated in FIG. 1.
FIG. 3*b* illustrates a bottom view of an alternative embodiment of the sock illustrated in FIG. 1.
Figure 4:
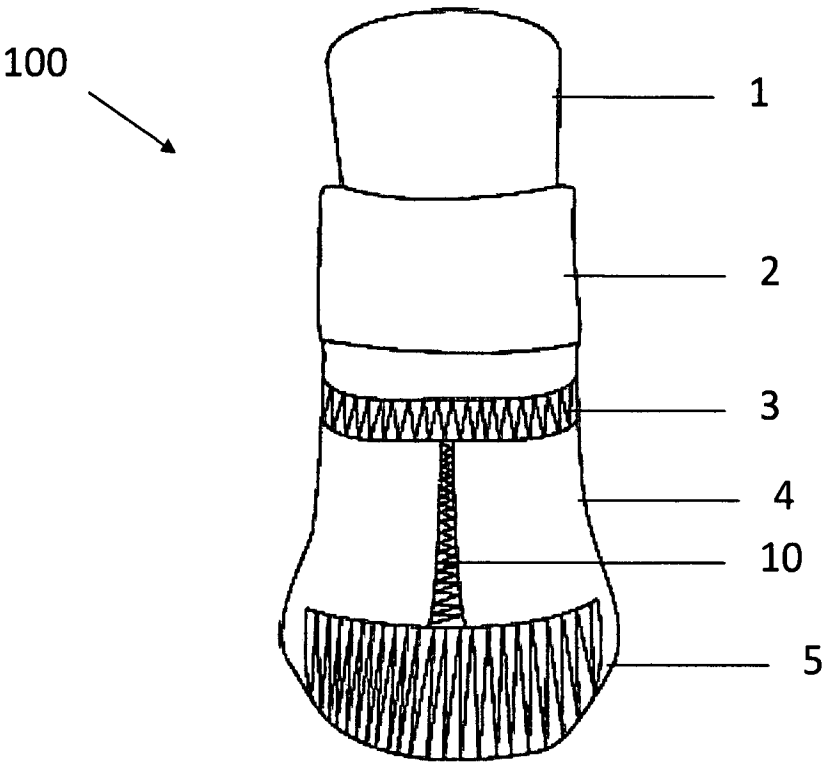
FIG. 4 illustrates a rear view of the embodiment of a sock illustrated in FIG. 1.
Figure 5:
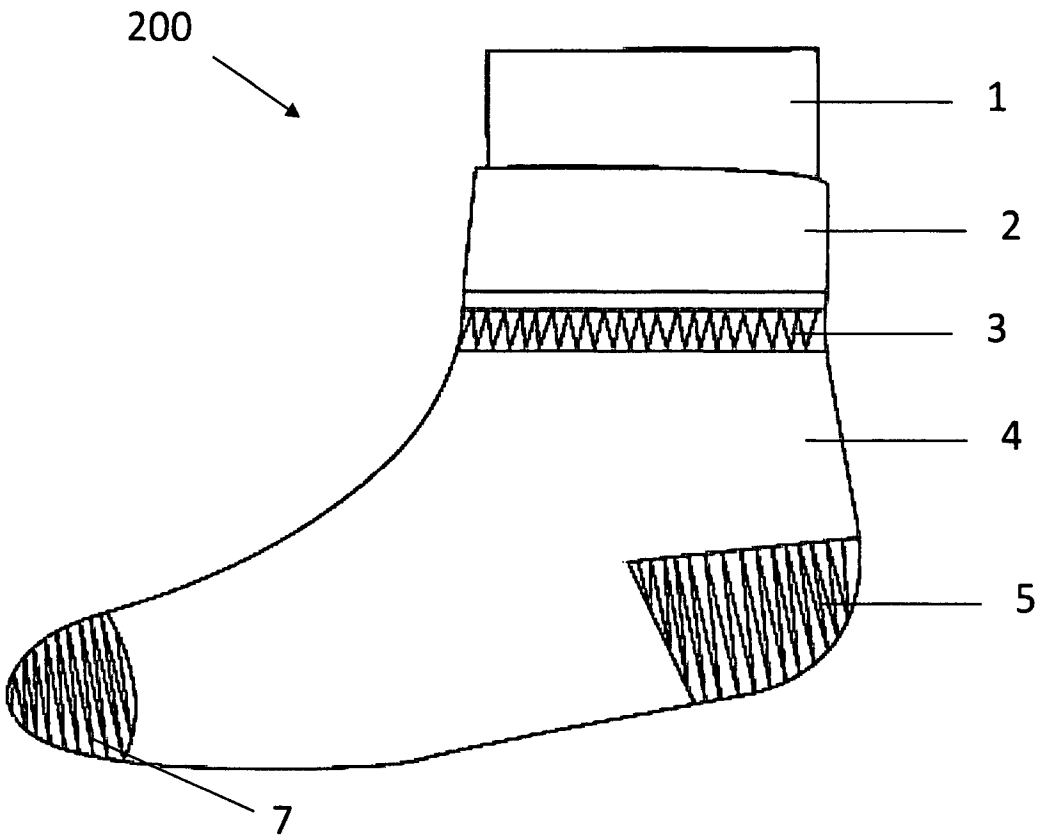
FIG. 5 illustrates a side view of a second embodiment of a sock constructed according to the disclosed principles.
Figure 6:
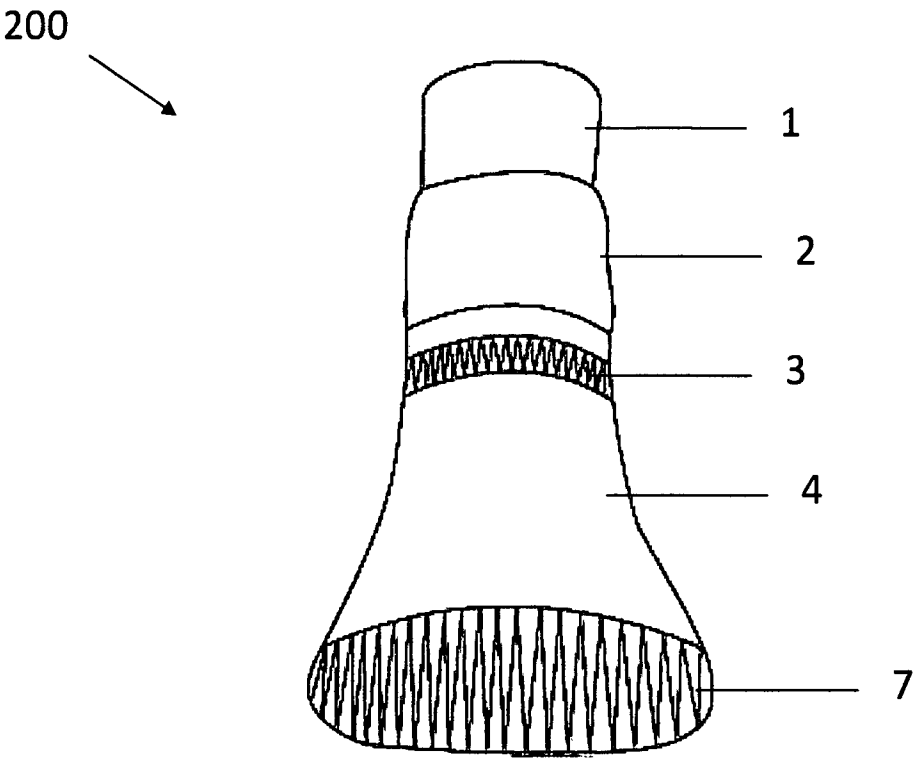
FIG. 6 illustrates a front view of the embodiment of a sock illustrated in FIG. 5.
Figure 7:
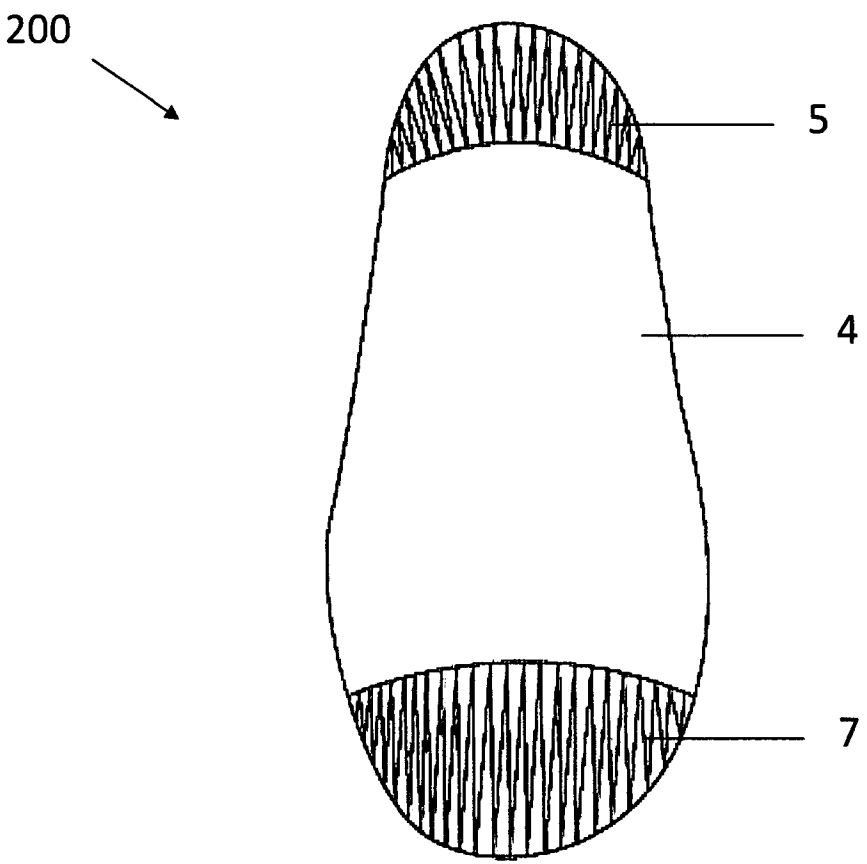
FIG. 7 illustrates a bottom view of the embodiment of a sock illustrated in FIG. 5.
Figure 8:
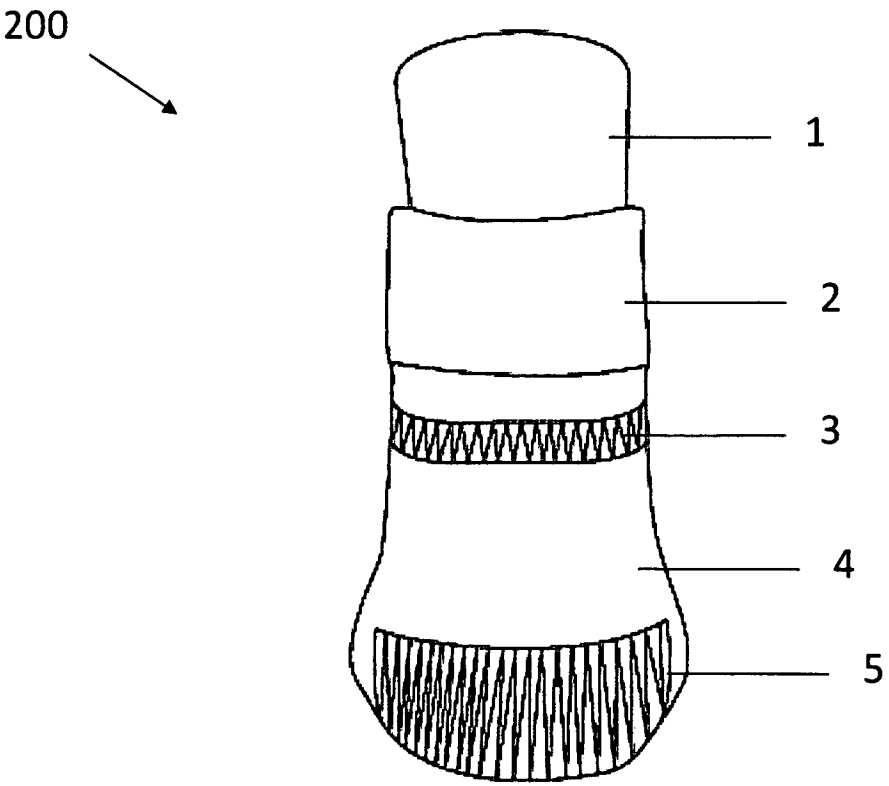
FIG. 8 illustrates a rear view of the embodiment of a sock illustrated in FIG. 5.
Figure 9:
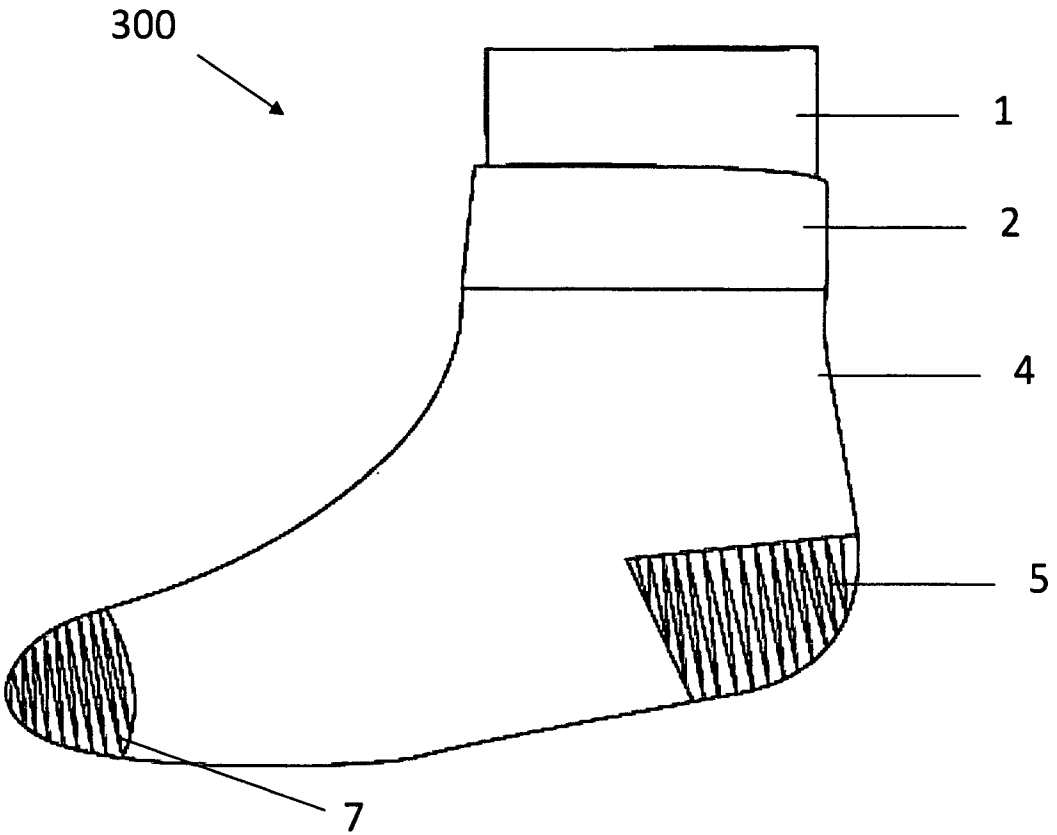
FIG. 9 illustrates a side view of a second embodiment of a sock constructed according to the disclosed principles.
Figure 10:
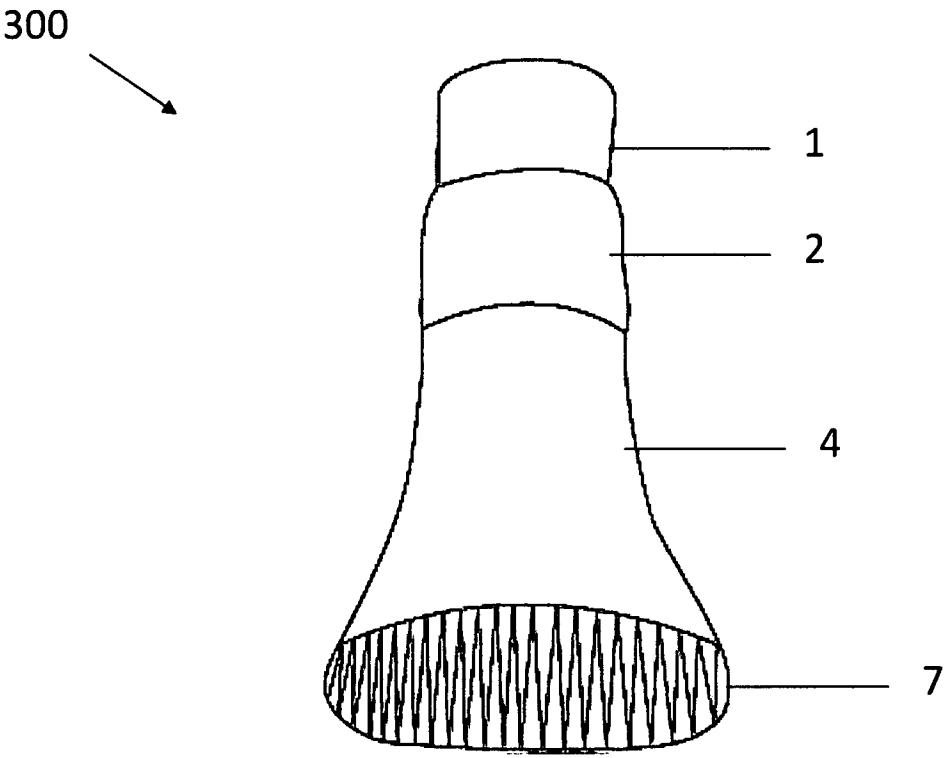
FIG. 10 illustrates a front view of the embodiment of a sock illustrated in FIG. 9.
Figure 11:
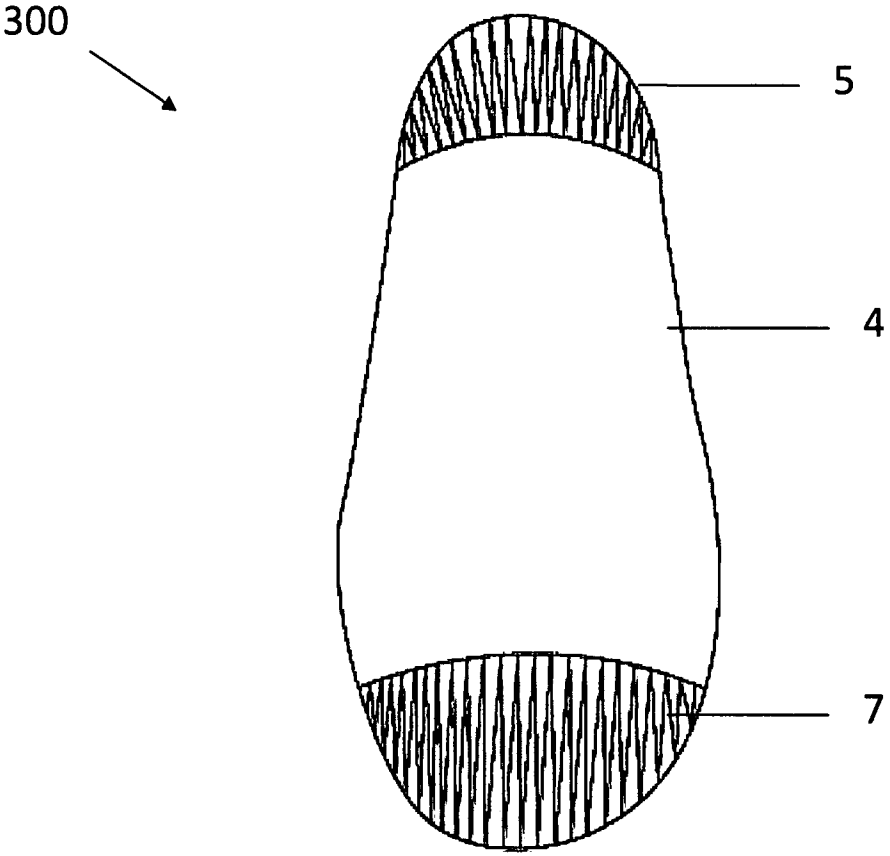
FIG. 11 illustrates a bottom view of the embodiment of a sock illustrated in FIG. 9.
Figure 12:
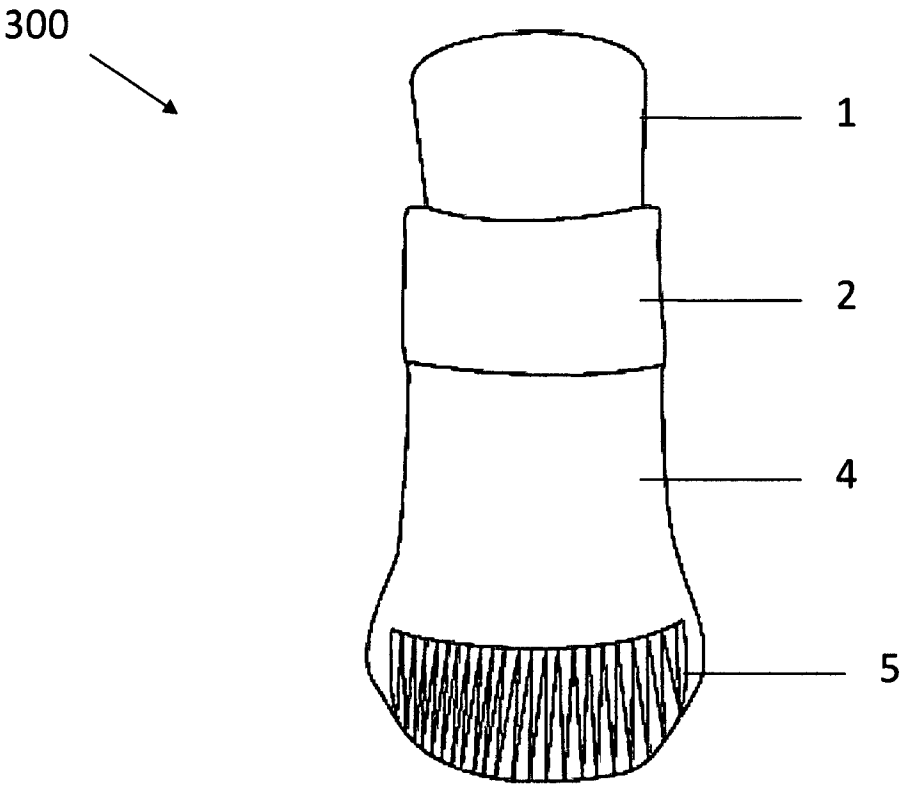
FIG. 12 illustrates a rear view of the embodiment of a sock illustrated in FIG. 9.
Figure 13:
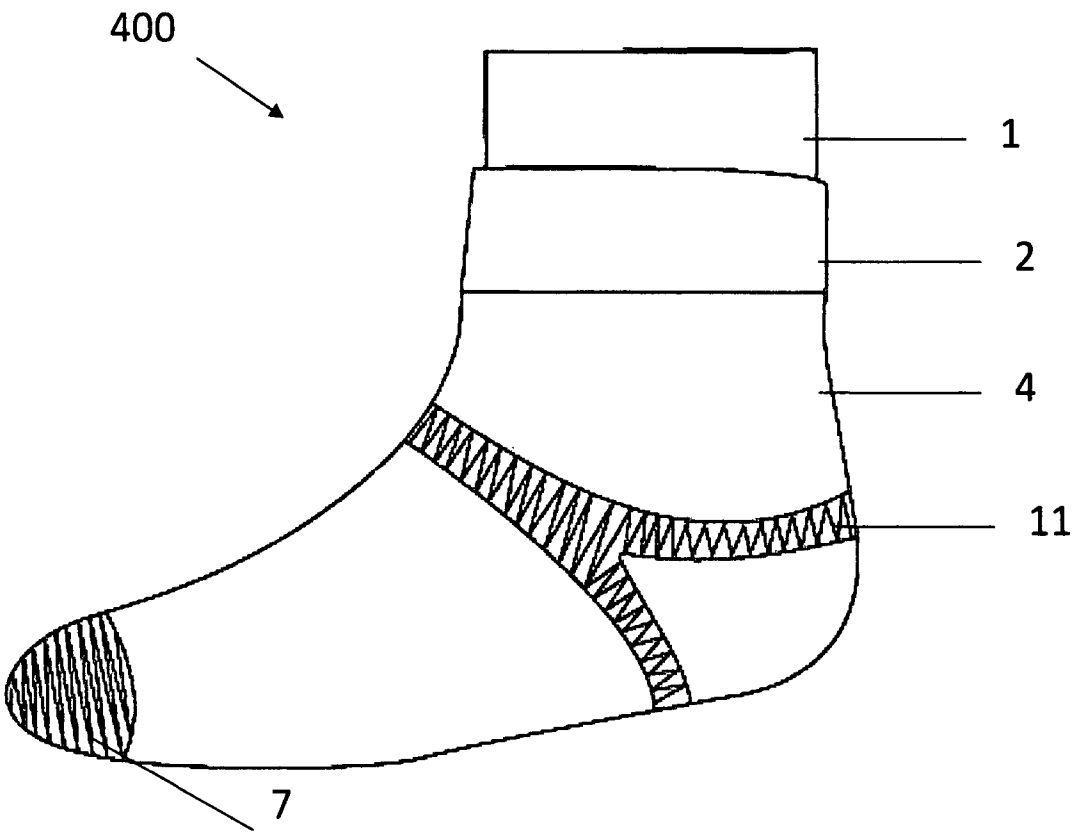
FIG. 13 illustrates a side view of a second embodiment of a sock constructed according to the disclosed principles.
Figure 14:
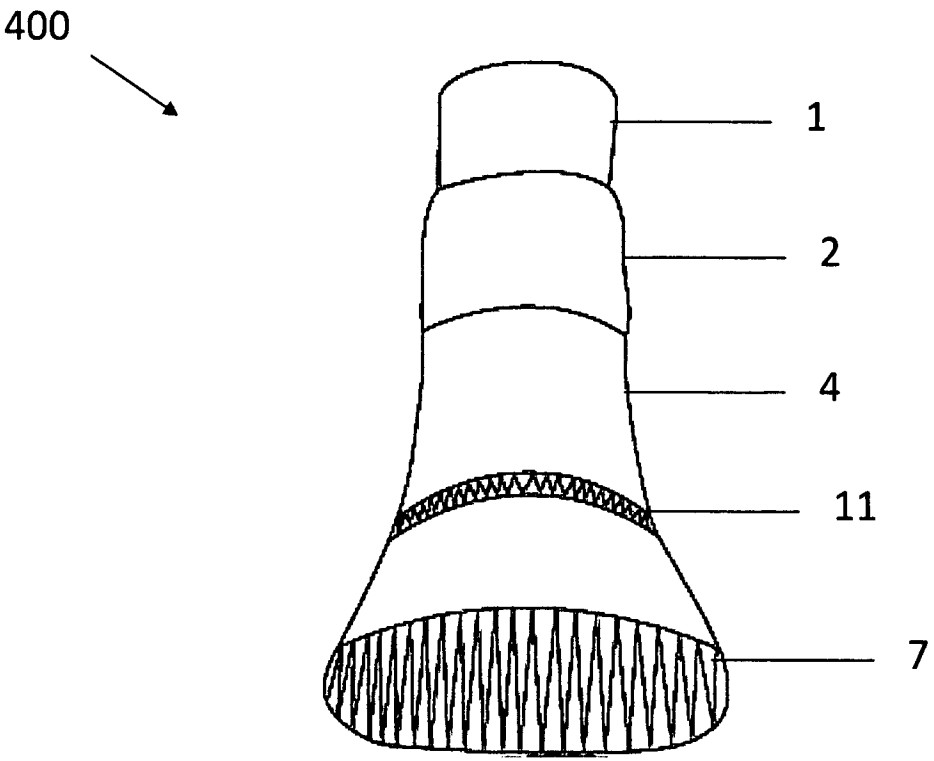
FIG. 14 illustrates a front view of the embodiment of a sock illustrated in FIG. 13.
Figure 15:
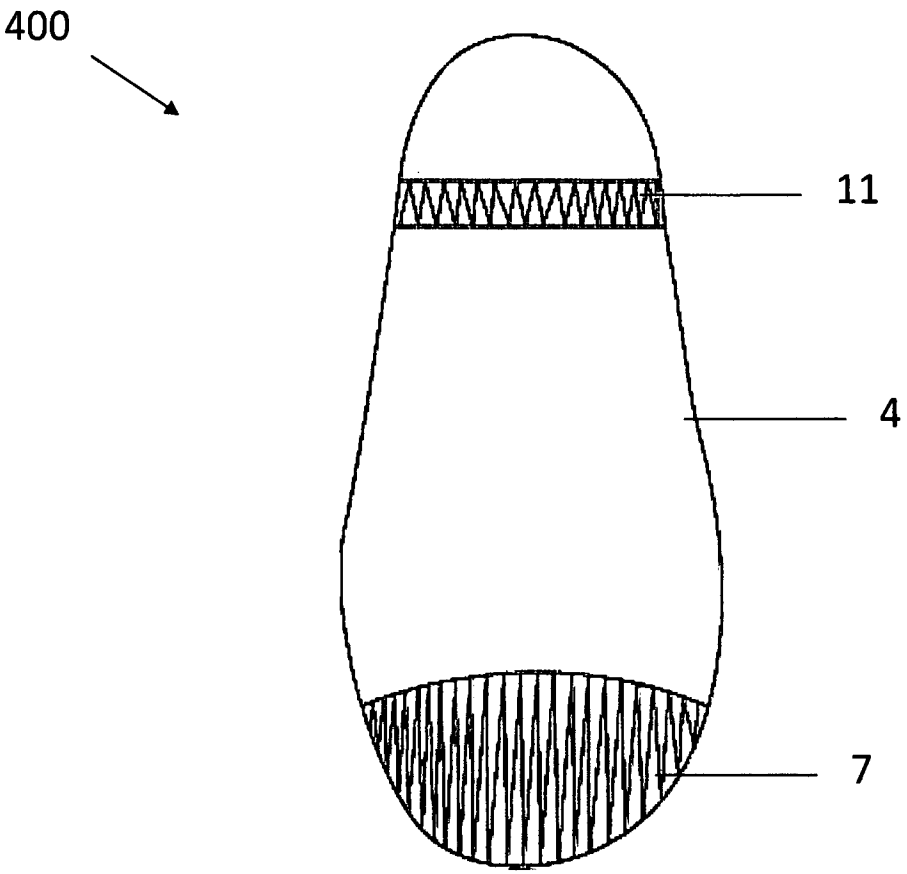
FIG. 15 illustrates a bottom view of the embodiment of a sock illustrated in FIG. 13.
Figure 16:
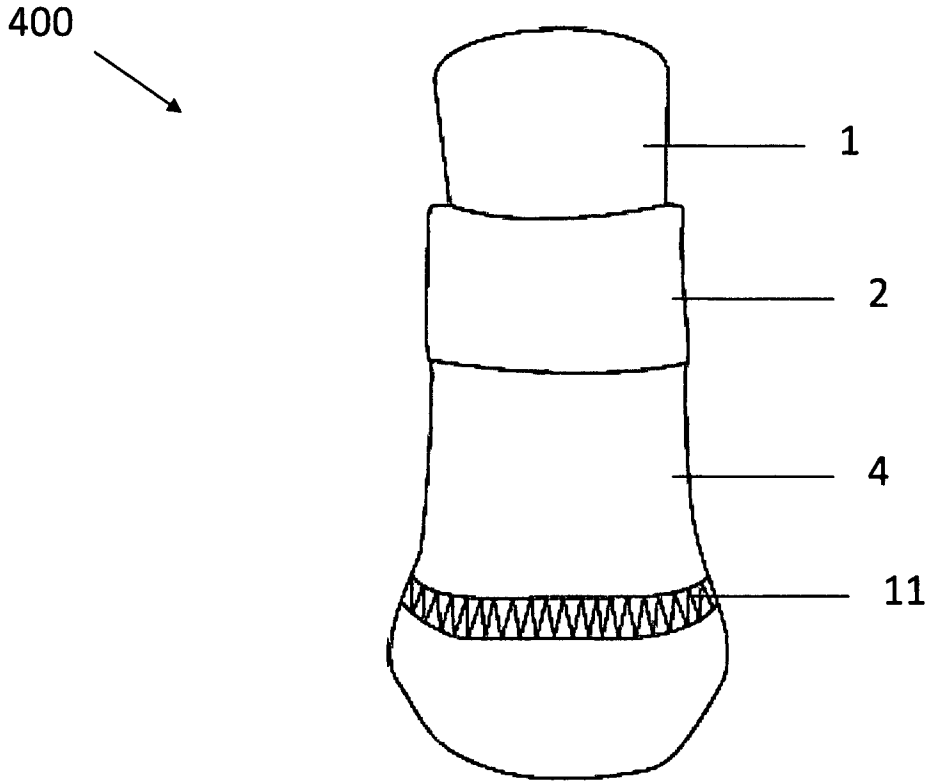
FIG. 16 illustrates a rear view of the embodiment of a sock illustrated in FIG. 15.

Similarly, when using the foot bottom strap 9 in this first embodiment, the foot bottom strap 9 is preferably connected from the toe portion 7 to the ankle band 3, as illustrated in FIG. 3. However, it could also be connected from the toe portion 7 to the foot cross band 6, as illustrated in FIG. 3*a*. Or the bottom strap 9 could be connected from the foot cross band 6 to the heel portion 5, as illustrated in FIG. 3*b*. As before, the embodiments illustrated in FIGS. 3, 3*a*, and 3*b* may stretch differently when the baby pulls on the toe or rubs its heels against an object, yet can still help keep the sock on the foot.

Turning now to FIGS. 5-8, illustrated are various view of a second exemplary embodiment of a sock 200 constructed according to the disclosed principles. Below is a list of the items illustrated in FIGS. 5-8, however as before, it should be noted that this list may not necessarily be exhaustive. Thus, related embodiments may have varying items, yet such embodiments may still fall within the disclosed principles.

Illustrated Items

1. Leg
2. Cuff of the sock
3. Ankle band
4. Sock body
5. Heel
7. Toe As illustrated in FIGS. 5-8, this second embodiment of a sock constructed according to the disclosed principles differs from the embodiment illustrated in FIGS. 1-4 in that this sock does not include the foot top band 8, foot bottom band 9, cross band 6, or Achilles band 10. Accordingly, this embodiment only provides the greater stretchability in the toe 7, heel 5, and ankle band 3 areas. However, by not including the foot top band 8, foot bottom band 9, cross band 6, or Achilles band 10 in this embodiment, construction costs and time as compared to the embodiment in FIGS. 1-4 may be substantially reduced if the added elasticity in these omitted areas is not required or desired.

As before, the items comprising the sock may be comprised of a knit material, and this material could be, but is not limited to, cotton, wool, bamboo, polyester, nylon, Spandex, or a blend of any one of these materials. As with the previous embodiments discussed above, the yarns may be cotton in items 2, 4 and nylon/Spandex in items 3, 5, 7. Of course, other materials may also be employed. As discussed above, it is the substantially greater elasticity, and thus stretchability, of the selected sections 3, 5, 7 of a sock constructed according to the disclosed principles that allows the sock to be more likely to stay on a foot than conventionally designed socks. The selected areas of the sock may, but are not required to, have the same elasticity and stretchability as other selected areas. The remaining portions may, but are not required to, have the same elasticity and stretchability as other remaining portions. The elasticity and stretchability within a selected area may, but is not required to, be the same. The elasticity and stretchability within a remaining portion may, but is not required to, be the same.

Referring now to FIGS. 9-12, illustrated are various view of a third exemplary embodiment of a sock 300 constructed according to the disclosed principles. Below is a list of the items illustrated in FIGS. 9-12, however as before, it should be noted that this list may not necessarily be exhaustive. Thus, related embodiments may have varying items, yet such embodiments may still fall within the disclosed principles.

Illustrated Items:

1. Leg
2. Cuff of the sock
4. Sock body
5. Heel
7. Toe

As illustrated in FIGS. 9-12, this third embodiment of a sock constructed according to the disclosed principles differs from the embodiment illustrated in FIGS. 1-4 in that this sock only includes the toe 7 and heel 5 areas of greater elasticity. As such, it does not include the foot top band 8, foot bottom band 9, cross band 6, or Achilles band 10. It also does not include the ankle band 3 that remains in the embodiment described with reference to FIGS. 5-8. Accordingly, this embodiment only provides the greater stretchability in the toe 7 and heel 5 areas. However, by not including the ankle band 3, foot top band 8, foot bottom band 9, cross band 6, or Achilles band 10 in this embodiment, construction costs and time as compared to the embodiments in FIGS. 1-4 and in FIGS. 5-8 may be substantially reduced if the added elasticity in these omitted areas is not required or desired.

As before, the items comprising the sock may be comprised of a knit material, and this material could be, but is not limited to, cotton, wool, bamboo, polyester, nylon, Spandex, or a blend of any one of these materials. As with the previous embodiments discussed above, the yarns may be cotton in items 2, 4 and nylon/Spandex in items 5 and 7. Of course, other materials may also be employed. As discussed above, it is the substantially greater elasticity, and thus stretchability, of the selected sections 5 and 7 of a sock constructed according to the disclosed principles that allows the sock to be more likely to stay on a foot than conventionally designed socks. The selected areas of the sock may, but are not required to, have the same elasticity and stretchability as other selected areas. The remaining portions may, but are not required to, have the same elasticity and stretchability as other remaining portions. The elasticity and stretchability within a selected area may, but is not required to, be the same. The elasticity and stretchability within a remaining portion may, but is not required to, be the same.

Turning now to FIGS. 13-16, illustrated are various view of a fourth exemplary embodiment of a sock 400 constructed according to the disclosed principles. Below is a list of the items illustrated in FIGS. 13-16, however as before, it should be noted that this list may not necessarily be exhaustive. Thus, related embodiments may have varying items, yet such embodiments may still fall within the disclosed principles.

Illustrated Items:

1. Leg
2. Cuff of the sock
4. Sock body
7. Toe
11. Y-Band

As illustrated in FIGS. 13-16, this fourth embodiment of a sock constructed according to the disclosed principles differs from the embodiment illustrated in FIGS. 1-4 in that this sock only includes the toe 7 area remains. In addition to the toe area 7, a "Y-band" 11 of greater elasticity that the sock body 4 is added in place of the heel area 5. As shown, the Y-band 11 extends laterally across the top of the foot, and then splits to wrap around both the front and back of the heel of the foot. By not including the other select areas of greater elasticity discuss in the previous embodiments, construction costs and time as compared to these previous embodiments may be further reduced if the added elasticity in these omitted areas is not required or desired.

As before, the items comprising the sock may be comprised of a knit material, and this material could be, but is not limited to, cotton, wool, bamboo, polyester, nylon, Spandex, or a blend of any one of these materials. As with the previous embodiments discussed above, the yarns may be cotton in items 2, 4 and nylon/Spandex in items 7 and 11. Of course, other materials may also be employed. As discussed above, it is the substantially greater elasticity, and thus stretchability, of the selected sections 7 and 11 of a sock constructed according to the disclosed principles that allows the sock to be more likely to stay on a foot than conventionally designed socks. The selected areas of the sock may, but are not required to, have the same elasticity and stretchability as other selected areas. The remaining portions may, but are not required to, have the same elasticity and stretchability as other remaining portions. The elasticity and stretchability within a selected area may, but is not required to, be the same. The elasticity and stretchability within a remaining portion may but is not required to be the same.

Figure 17:
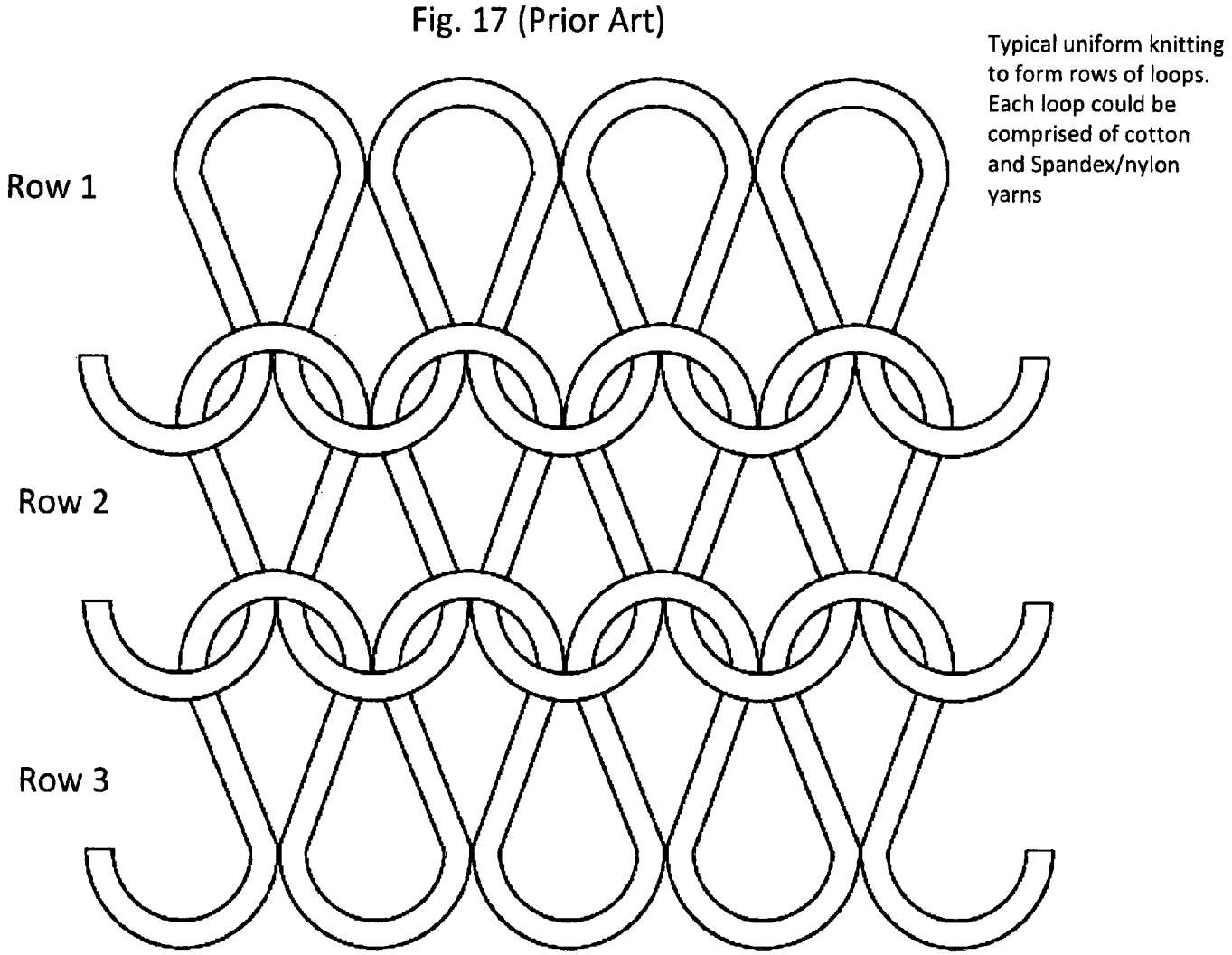
Fig. 17 (Prior Art)
FIG. 17 illustrates a conventional uniform knitting pattern across a conventional sock.
Figure 18:
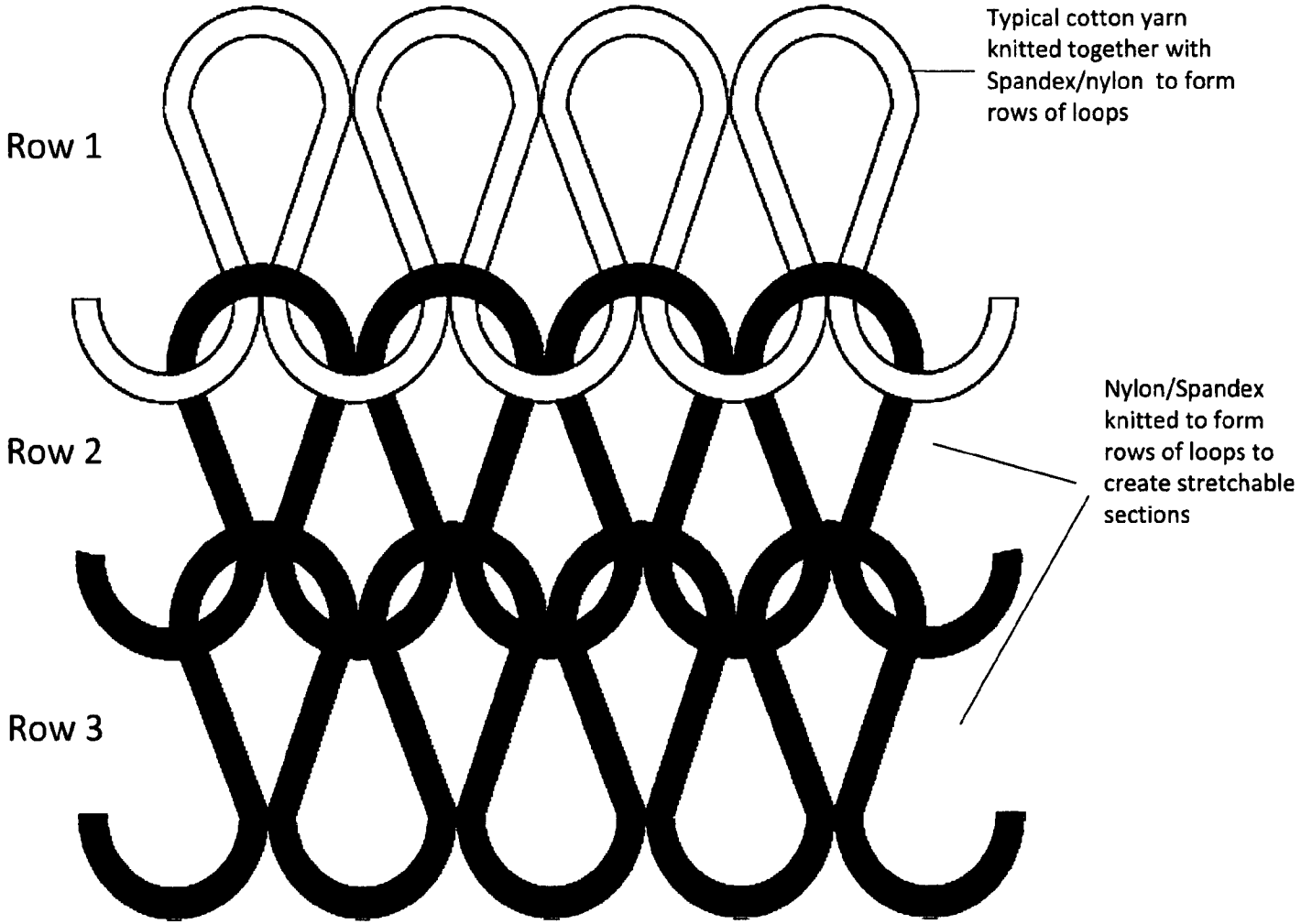
FIG. 18 illustrates one embodiment of a knitting pattern where the loops of a selected area of greater stretchability as disclosed herein are knitted to the loops of a conventional sock material.
Figure 19:
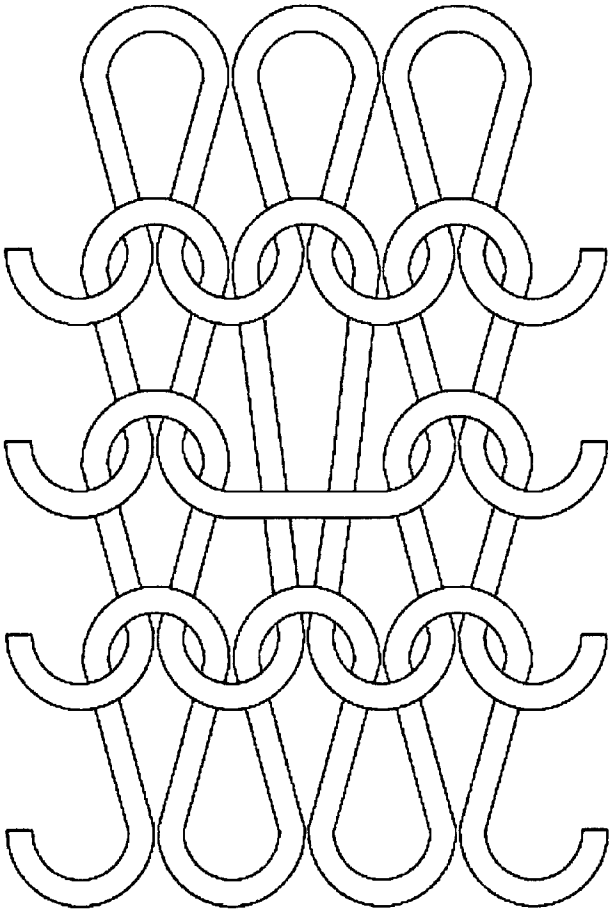
FIG. 19 illustrates a float stitch which determines the stretchability of the sock

Turning now to FIGS. 17 and 18, illustrated are a uniform knitting pattern across a conventional sock (FIG. 17), and a knitting pattern of a selected area of greater stretchability as disclosed herein knitted to a conventional sock material (FIG. 18). FIG. 18 illustrates that conventional knitting equipment, may be used to connect the yarns of typical materials used in conventional sock manufacturing with the material having yarns with the substantially greater elasticity used in the selected areas disclosed herein. Stated another way, loops of substantially greater elasticity may be knitted to loops of typical yarns used in conventional socks to create the select areas disclosed herein. Thus, in such embodiments where yarns having substantially greater elasticity are employed, joining the selected areas of greater stretchability and the remainder of the sock body could be seamless. FIG. 19 illustrates a float stitch which is commonly used in the knitting industry. The yarns of the selected areas and remaining portions may be the same in embodiments incorporating such a stitch pattern. In such embodiments, the elasticity and stretchability may be varied by the type of stitch instead of the type of yarns. The float stitch is just an example of a type of stitch that could be used to change the elasticity and stretchability of the selected areas as compared to the remaining portions, although other stitches may be used. Accordingly, manufacturing socks according to the disclosed principles would require little or no elevation in manufacturing expenses.

While various embodiments of the principles disclosed herein have been described above, it should be understood that they have been presented by way of example only, and not limitation. For example, although nylon/Spandex is mentioned in this example, other materials may also be used. Persons of ordinary skill in this art may implement the disclosed principles by varying the number of courses (horizontal rows of knit loops), wales (vertical rows of knit loops), or type of stitch of the chosen knit material in the sock. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A sock for wearing on a foot, the sock comprising:

body portions of the sock comprising a material having a first overall stretchability;

select portions of the sock comprising a material having a second overall stretchability, wherein the select portions comprise substantially less of the sock than the body portions, and comprise a toe area of the sock and a cross band area wrapping completely around the top and bottom of the sock in an arch area of the sock, as well as a foot top band connected to and extending along a top of the sock between the toe area and the cross band;

wherein the second stretchability is substantially greater than the first stretchability such that one or more of the select portions are configured to continue to stretch in response to a removal force applied to the sock while adjacent one or more body portions reach their maximum stretchable length which thereby allows the removal force to overcome a compressive force of the one or more body portions.

2. A sock according to claim 1, wherein the select portions further comprise a Y-band area wrapping around a top of the sock opposite a heel area, and around both a front and back of the heel area of the sock.

3. A sock according to claim 1, wherein the select portions further comprise a heel area of the sock.

4. A sock according to claim 3, wherein the select portions further comprise an ankle band wrapping around an ankle area of the sock.

5. A sock according to claim 4, wherein the select portions further comprise an Achilles band connected to and extending between a backmost portion of the ankle band and back portion of the heel area.

6. A sock according to claim 1, wherein the select portions further comprise an ankle band wrapping around an ankle area of the sock and a foot top band extending along a top of the sock connecting the cross band and the ankle band.

7. A sock according to claim 1, wherein the select portions further comprise an ankle band wrapping around an ankle area of the sock.

8. A sock according to claim 1, wherein the select portions further comprise a foot bottom band extending along a bottom of the sock connecting the toe area and the cross band.

9. A sock according to claim 1, wherein the select portions further comprise an ankle band wrapping around an ankle area of the sock and a foot bottom band extending along a bottom of the sock connecting the cross band and the ankle band.

10. A sock according to claim 1, wherein the select portions further comprise an ankle band wrapping around an ankle area of the sock and a foot bottom band extending along a bottom of the sock connecting the toe area and the ankle band.

11. A sock according to claim 1, wherein yarns comprising the material of the select portions differ from yarns comprising the material of the body portions, wherein the yarns of the select portions have a substantially greater elasticity than the yarns of the body portions to provide the substantially greater stretchability of the select portions.

12. A sock according to claim 1, wherein yarns comprising the material of the body portions are the same as yarns comprising the material of the select portions, wherein a knitting pattern of the select portions differs from a knitting pattern of the body portions to provide the substantially greater stretchability of the select portions.

13. A sock for wearing on a foot, the sock comprising:

body portions of the sock comprising a material having a first overall stretchability;

select portions of the sock, including at least:

a toe area, a heel area, a cross band area wrapping completely around the top and bottom of the sock in an arch area of the sock, an ankle band wrapping around an ankle area of the sock, and a foot top band extending along a top of the sock connecting the cross band and the ankle band, the toe area and the ankle band, or the toe area and the cross band;

wherein the select portions comprise substantially less of the sock than the body portions and comprise a material having a second overall stretchability; and wherein the second stretchability is substantially greater than the first stretchability such that one or more of the select portions are configured to continue to stretch in response to a removal force applied to the sock while adjacent one or more body portions reach their maximum stretchable length which thereby allows the removal force to overcome a compressive force of the one or more body portions.

14. A sock according to claim 13, wherein yarns comprising the material of the select portions differ from yarns comprising the material of the body portions, wherein the yarns of the select portions have a substantially greater elasticity than the yarns of the body portions to provide the substantially greater stretchability of the select portions.

15. A sock according to claim 13, wherein yarns comprising the material of the body portions are the same as yarns comprising the material of the select portions, wherein a knitting pattern of the select portions differs from a knitting pattern of the body portions to provide the substantially greater stretchability of the select portions.

16. A sock for wearing on a foot, the sock comprising:

body portions of the sock comprising a material having a first overall stretchability;

select portions of the sock, including at least:

a toe area, a heel area, a cross band area wrapping completely around the top and bottom of the sock in an arch area of the sock, and a foot bottom band extending along a bottom of the sock connecting the toe area and the heel area, the toe area and the cross band, or the cross band and the heel area;

wherein the select portions comprise substantially less of the sock than the body portions and comprise a material having a second overall stretchability; and wherein the second stretchability is substantially greater than the first stretchability such that one or more of the select portions are configured to continue to stretch in response to a removal force applied to the sock while adjacent one or more body portions reach their maximum stretchable length which thereby allows the removal force to overcome a compressive force of the one or more body portions.

17. A sock according to claim 16, wherein yarns comprising the material of the select portions differ from yarns comprising the material of the body portions, wherein the yarns of the select portions have a substantially greater elasticity than the yarns of the body portions to provide the substantially greater stretchability of the select portions.

18. A sock according to claim 16, wherein yarns comprising the material of the body portions are the same as yarns comprising the material of the select portions, wherein a knitting pattern of the select portions differs from a knitting pattern of the body portions to provide the substantially greater stretchability of the select portions.

* * * * *